US010304640B2

(12) United States Patent
Chen et al.

(10) Patent No.: US 10,304,640 B2
(45) Date of Patent: May 28, 2019

(54) MECHANICAL INTERLOCK ASSEMBLY FOR DISCONNECTOR AND EARTHING SWITCH

(71) Applicant: ABB Schweiz AG, Baden (CH)

(72) Inventors: Rui Chen, Beijing (CN); Zhipeng Yuan, Beijing (CN); Xuan Liu, Beijing (CN); Jiaquan Yan, Guangdong (CN)

(73) Assignee: ABB Schweiz AG, Baden (CH)

( * ) Notice: Subject to any disclaimer, the term of this patent is extended or adjusted under 35 U.S.C. 154(b) by 40 days.

(21) Appl. No.: 15/663,486

(22) Filed: Jul. 28, 2017

(65) Prior Publication Data

US 2017/0330702 A1 Nov. 16, 2017

Related U.S. Application Data

(63) Continuation of application No. PCT/CN2015/071761, filed on Jan. 28, 2015.

(51) Int. Cl.
*H01H 9/24* (2006.01)
*H01H 3/46* (2006.01)
(Continued)

(52) U.S. Cl.
CPC ..... *H01H 9/24* (2013.01); *H01H 3/46* (2013.01); *H01H 9/26* (2013.01); *H01H 31/003* (2013.01);
(Continued)

(58) Field of Classification Search
CPC ..... H01H 9/24; H01H 31/10; H01H 31/003; H01H 9/26; H01H 33/42; H01H 3/46; H01H 31/32; H01H 31/28; H01H 31/08
(Continued)

(56) References Cited

U.S. PATENT DOCUMENTS 6,329,615 B1 * 12/2001 Biquez ..... H01H 33/52 200/43.11
8,487,203 B2 * 7/2013 Shin ..... H01H 3/46 218/43
(Continued)

FOREIGN PATENT DOCUMENTS

CN 201421784 Y 3/2010
CN 102484012 A 5/2012
(Continued)

OTHER PUBLICATIONS

International Search Report and Written Opinion, PCT/CN2015/071761, dated Oct. 21, 2015, 12 pages.
(Continued)

*Primary Examiner* — Edwin A. Leon
*Assistant Examiner* — Lheiren Mae A Caroc
(74) *Attorney, Agent, or Firm* — Taft Stettinius & Hollister LLP

(57) ABSTRACT

A mechanical interlock assembly for a disconnector and an earthing switch. The mechanical interlock assembly comprises: a main interlock disc configured to actuate a movable contact of a disconnector, and at least one earthing switch interlock disc configured to actuate respective movable contact of at least one earthing switch respectively. The main interlock disc includes at least one first groove, and each of the at least one earthing switch interlock discs includes a third groove, and it is provided with a movable interlock pin between the main interlock disc and each earthing switch interlock disc respectively. The interlock assembly can interlock the disconnector and the at least one earthing switch, and has the advantages of a simple structure, low cost and flexibility for different arrangements. A further mechanical interlock assembly is also provided to interlock another
(Continued)

disconnector and one of the above at least one earthing switch.

18 Claims, 10 Drawing Sheets

(51) Int. Cl.

| | |
|---|---|
| ***H01H 31/32*** | (2006.01) |
| ***H01H 33/42*** | (2006.01) |
| ***H01H 9/26*** | (2006.01) |
| ***H01H 31/00*** | (2006.01) |
| ***H01H 31/10*** | (2006.01) |
| *H01H 31/08* | (2006.01) |
| *H01H 31/28* | (2006.01) |

(52) U.S. Cl.
CPC ..... *H01H 31/10* (2013.01); *H01H 31/32* (2013.01); *H01H 33/42* (2013.01); *H01H 31/08* (2013.01); *H01H 31/28* (2013.01)

(58) Field of Classification Search
USPC ..... 200/5 B, 43.01, 43.11, 43.16, 43.19, 200/50.01, 50.32–50.35, 50.37, 50.39
See application file for complete search history.

(56) References Cited

U.S. PATENT DOCUMENTS

| | | | |
|---|---|---|---|
| 2012/0012449 | A1 | 1/2012 | Shin et al. |
| 2012/0124491 | A1 | 1/2012 | Shin et al. |

FOREIGN PATENT DOCUMENTS

| | | | |
|---|---|---|---|
| CN | 203434031 | U | 2/2014 |
| CN | 203491148 | U | 3/2014 |
| DE | 2206490 | A1 | 8/1973 |
| RU | 2194325 | C2 | 12/2002 |
| SU | 271609 | A1 | 12/1970 |

OTHER PUBLICATIONS

Russian Search Report, Russian Patent Application No. 2017130130/07, dated Jul. 31, 2018, 4 pages, including English translation.

* cited by examiner

MECHANICAL INTERLOCK ASSEMBLY FOR DISCONNECTOR AND EARTHING SWITCH

FIELD OF INVENTION

Embodiments of the present disclosure relate to the field of a mechanical interlock assembly for a disconnector and an earthing switch, and to a switch device having such mechanical interlock assembly.

BACKGROUND ART

Disconnector is a mechanical switch for isolating electrical devices from a power line, which is typically used in high voltage environment to form a visible disconnecting point to ensure a reliable isolation of electrical devices from a power line, such that the electrical devices can be operated or maintained safely without load. Usually, at least one earthing switch is used together with the disconnector to connect the isolated electrical devices to the ground such that a capacitive current or an inductive current remained on the isolated electrical devices can be eliminated and the isolated electrical devices can be operated or maintained more safely.

It is a basic requirement that a disconnector and the associated earthing switches cannot be in closed state at the same time, otherwise it would result in an accident leading a large current into ground. Therefore, it is necessary to provide an interlock mechanism between a disconnector and the associated earthing switches to avoid the close of the disconnector and the associated earthing switches at the same time due to wrong operation by an operator error or a failure in actuating devices for the disconnector and the associated earthing switches.

The existing mechanical interlocks between a disconnector (i.e. DS) and the associated earthing switches (i.e. ES) are mostly provided on the mechanism side and on vertical transmitting rods. These interlocks need welding parts or splined shaft to mount the interlocks on the vertical transmitting rods. These structures are not only very complicated and expensive, but also quite difficult for installation and maintenance. For the existing interlocks between a disconnector and associated earthing switches located at long distance from the disconnector, the interlocks are more complicated and less reliable, and are also quite difficult for installation and maintenance.

Therefore, it requires to provide an interlock mechanism between a disconnector and associated earthing switches, which is more simple in structure and more reliable, and is easy for installation and maintenance.

SUMMARY OF INVENTION

Hence, in order to overcome one or more of the deficiencies in the prior art mentioned above, one of objectives of embodiments of the present disclosure is to provide a mechanical interlock assembly for a disconnector and an earthing switch.

According to one aspect of the embodiments of the present disclosure, there is provided a first mechanical interlock assembly for a disconnector and an earthing switch, comprising: a main interlock disc configured to actuate a movable contact of a disconnector, and at least one earthing switch interlock disc configured to actuate respective movable contact of at least one earthing switch respectively. The main interlock disc is provided with at least one first groove, and each of the at least one earthing switch interlock disc is provided with a third groove, and between the main interlock disc and each earthing switch interlock disc is provided with a movable interlock pin respectively.

The at leas tone first groove is aligned with the respective interlock pin when the movable contact of the disconnector is in an open position, such that each of the earthing switch interlock disc is rotatable to push the respective interlock pin to engage with the at least one first groove respectively to stop the main interlock disc from rotating so as to lock the movable contact of the disconnector in the open position while the movable contact of the at least one earthing switch is moved to a closed position; and the third groove on each of the at least one earthing switch interlock disc is aligned with the respective interlock pin when the movable contact of each of the earthing switch is in an open position, such that the main interlock disc is rotatable to push the respective interlock pin to engage with the third groove on each of the at least one earthing switch interlock disc respectively to stop each of the at least one earthing switch interlock disc from rotating so as to lock the movable contact of each earthing switch in the open position while the movable contact of the disconnector is moved to a closed position.

According to one aspect of the embodiments of the present disclosure, the main interlock disc, the at least one earthing switch interlock disc and the respective interlock pin are supported by a switch seat, and said switch seat is configured to pivotably support the movable contact of one of the first and second earthing switches.

According to one aspect of the embodiments of the present disclosure, the mechanical interlock assembly comprises two earthing switch interlock discs disposed on two opposite sides of the switch seat respectively, and the main interlock discs disposed on one end of the switch seat between the two opposite sides, and two first grooves are provide on the main interlock disc along the circumferential direction of the main interlock disc.

According to one aspect of the embodiments of the present disclosure, each of the at least one earthing switch interlock discs comprises an arm extending from the circumference of the earthing switch interlock discs in the radial direction for connecting a linkage mechanism to actuate the movable contact of the corresponding earthing switch.

According to one aspect of the embodiments of the present disclosure, the respective interlock pin is rounded at both ends thereof.

According to one aspect of the embodiments of the present disclosure, the main interlock disc further comprises a second groove on the circumference of the main interlock disc which can be used to be engaged with an interlock rod to interlock the disconnector connected to the main interlock disc and an additional earthing switch.

According to one aspect of the embodiments of the present disclosure, the second groove is dislocated with the at least one first groove axially and circumferentially.

According to one aspect of the embodiments of the present disclosure, a second mechanical interlock assembly for a disconnector and an earthing switch is provided, comprising: a main interlock disc having a second groove on the circumference of the main interlock disc, configured to actuate a movable contact of a disconnector; an interlock plate, which is fixed to a pivot of a movable contact of an earthing switch; and an interlock rod movably supported between the main interlock disc and the interlock plate. The second groove is aligned with the interlock rod when the movable contact of the disconnector is in an open position, such that the interlock plate is rotatable in a first direction along with the movable contact of the earthing switch to push the interlock rod to engage with the second groove to stop the main interlock disc from rotating so as to lock the movable contact of the disconnector in the open position while the movable contact of the earthing switch is rotated to a closed position; and the main interlock disc is rotatable when the movable contact of the earthing switch is in an open position, to push the interlock rod to move towards the interlock plate to stop the interlock plate from rotating in the first direction so as to lock the movable contact of the earthing switch in the open position while the movable contact of the disconnector is actuated to a closed position.

According to one aspect of the embodiments of the present disclosure, the interlock plate comprises a first engaging surface and a second engaging surface, wherein the first engaging surface and the second engaging surface are configured such that: the distance between the rotating axis of the main interlock disc and the first engaging surface when the first engaging surface is rotated to right face the main interlock disc, is greater than the distance between the rotating axis of the main interlock disc and the second engaging surface when the second engaging surface is rotated to right face the main interlock disc.

According to one aspect of the embodiments of the present disclosure, one end of the interlock rod engaging with the second groove is rounded, and the other end of the interlock rod engaging with the interlock plate is planar.

According to one aspect of the embodiments of the present disclosure, the interlock rod is supported by at least one roller, and is guided by at least one guiding member.

According to one aspect of the embodiments of the present disclosure, the main interlock disc is supported on a switch seat, and said switch seat is configured to pivotably support a movable contact of at least one additional earthing switch.

According to one aspect of the embodiments of the present disclosure, the interlock assembly further comprises at least one earthing switch interlock disc configured to actuate a movable contact of at least one additional earthing switch respectively. The main interlock disc is further provided with at least one first groove, and each of the at least one earthing switch interlock disc is provided with a third groove, and between the main interlock disc and each of the earthing switch interlock discs is provided with an movable interlock pin respectively for engaging with the first groove or the third groove on the at least one earthing switch interlock disc, so as to interlock the disconnector and the at least one additional earthing switch.

According to one aspect of the embodiments of the present disclosure, a switch device is provided, comprising a disconnector, at least one earthing switch and the first mechanical interlock assembly for a disconnector and an earthing switch as described above. The at least one earthing switch is connected with the disconnector on the movable contact side and/or the stationary contact side of the disconnector.

According to one aspect of the embodiments of the present disclosure, a further switch device is provided, comprising a first disconnector having a first movable contact, a second disconnector having a second movable contact, at least one earthing switch and a second mechanical interlock assembly for a disconnector and an earthing switch as described above. One of the at least one earthing switch is connected to a common stationary contact side of the first and second disconnectors, and the interlock plate of the second mechanical interlock assembly is fixed to the pivot pin of the movable contact of the earthing switch connected to the common stationary contact side; and the main interlock disc of the second mechanical interlock assembly is configured to actuate the second movable contact of the second disconnector, such that the second mechanical interlock assembly is configured to interlock the second movable contact of the second disconnector and the earthing switch connected to the common stationary contact side.

According to one aspect of the embodiments of the present disclosure, the switch device further comprises a first mechanical interlock assembly for a disconnector and an earthing switch as described above. The main interlock disc of the first mechanical interlock assembly is configured to actuate the first movable contact of the first disconnector, and one of the at least one earthing switch interlock disc of the first mechanical interlock assembly is configured to actuate the movable contact of the earthing switch connected to the common stationary contact side, such that the first mechanical interlock assembly is configured to interlock the first movable contact of the first disconnector and the earthing switch connected to the common stationary contact side.

The interlock assembly in the present invention is provided on the location of the switch seat, which does not need complicated and expensive parts to be coupled with the transmission shafts, and fully uses the space of the switch seat and thus saves the total space for the switch device. Furthermore, since some parts, for example, the main interlock disc and the earthing interlock disc, are existing parts for actuating the disconnector and the earthing switch, the reuse of these parts for interlock function further saves the total number of the parts for the switch device, which reduces the cost for the interlock assembly. In addition, since the structure of the interlock assembly is simple, the installation and maintenance for the assembly is easy, and the reliability for interlock is further improved. The interlock assembly is flexible to be installed in different arrangements having disconnector and earthing switches in different ways to realize the interlock between the disconnector and the earthing switches.

BRIEF DESCRIPTION OF THE DRAWINGS

When reading the following detailed description on the exemplary embodiments with reference to the drawings, the aim, features and advantages of the present disclosure become obvious, wherein.

DETAILED DESCRIPTION OF EMBODIMENTS

Figure 1:
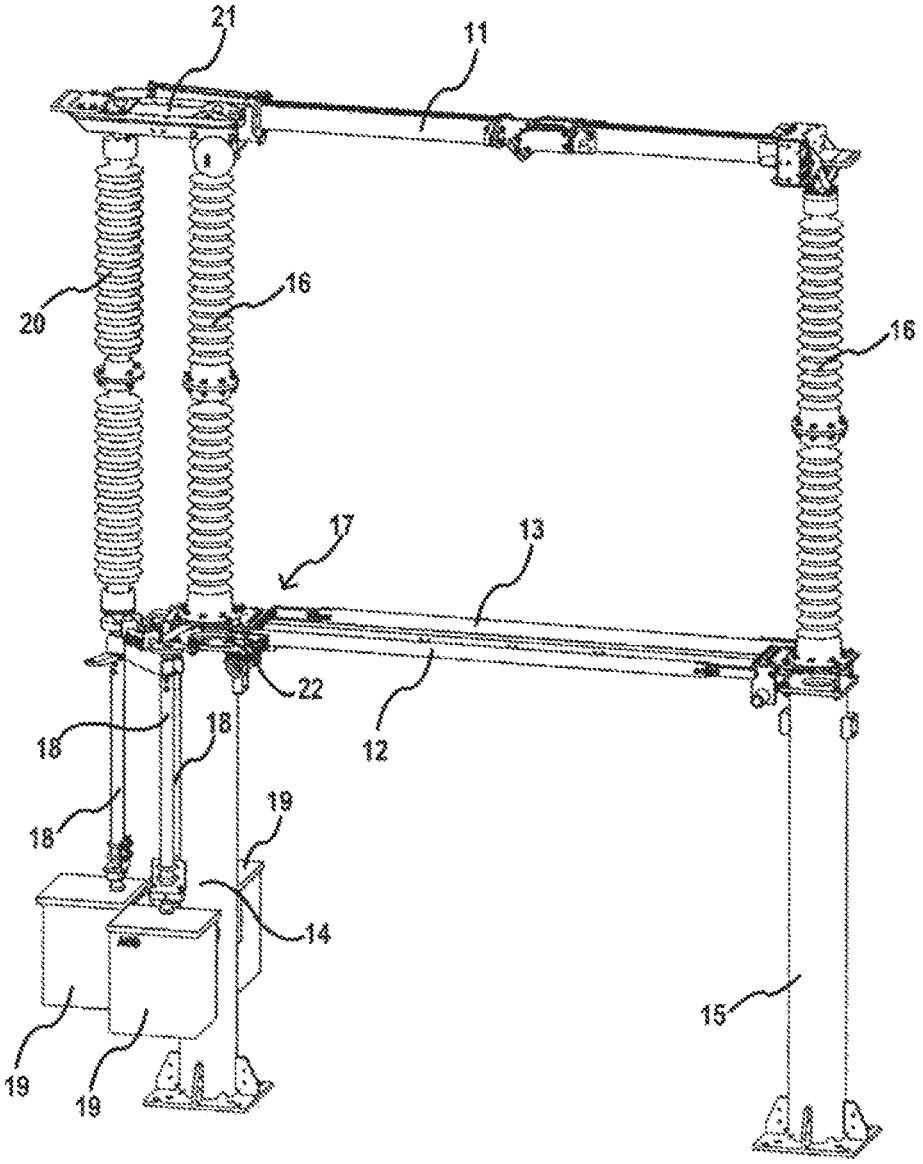
FIG. 1 illustrates a switch device, comprising a mechanical interlock assembly for a disconnector and an earthing switch according to an embodiment of the present invention.

Hereinafter, exemplary embodiments will be referred to in describing the mechanism and spirit of the present disclosure. It should be understood that these embodiments are merely provided to facilitate those skilled in the art in understanding and in turn implementing the present disclosure, but not for limiting the scope of the present disclosure in any way.

Various embodiments of the present disclosure are described in detail herein in an exemplary way by referring to the drawings.

FIG. 1 illustrates an exemplary switch device. The switch device comprises a disconnector 11, a first associated earthing switch 12 and a second associated earthing switch 13. The disconnector 11 comprises a movable contact and a stationary contact. The movable contact is pivotally supported on a first mounting column 14 and insulated from the first mounting column 14 with an insulating member 16 (for example, a ceramic insulating member). The stationary contact is mounted on a second mounting column 15 and insulated from the second mounting column 15 with an insulating member 16. The movable contact and the stationary contact of the disconnector 11 are electrically connected to the two ends of a power line (such as a bushbar in a high voltage system), and are used respectively for isolating one end of the power line from the other end of the power line in a visible manner after a circuit breaker in this power line has been opened. A movable contact of the first earthing switch 12 is pivotably supported to the first mounting column 14, and a movable contact of the second earthing switch 13 is pivotally supported to the second mounting column 15. The stationary contacts of the first earthing switch 12 and the second earthing switch 13 are arranged right above the pivot axis of the respective movable contacts of the first and second earthing switches and are not shown in FIG. 1. The first earthing switch 12 is electrically connected between one end of the power line to which the movable contact of the disconnector 11 is connected and the ground. The second earthing switch 14 is electrically connected between the other end of the power line to which the stationary contact of the disconnector 11 is connected and the ground.

As shown in FIG. 1, when the movable contact of the disconnector 11 is in horizontal position, the disconnector 11 is in a closed state to close the power line. In this case, the movable contacts of the first earthing switch 12 and the second earthing switch 13 must be kept in nearly horizontal position to be kept away form the respective stationary contacts of the earthing switches, so as to be in an open state to avoid leading large current to the ground. To the contrary, when the movable contacts of the first earthing switch 12 and the second earthing switch 13 are in vertical position, the first earthing switch 12 and the second earthing switch 13 are in a closed state to connect two ends of the power line to the ground. In this case, the disconnector 11 is prohibited to be closed to prevent closing the power line while the earthing switches are still closed.

Figure 2:
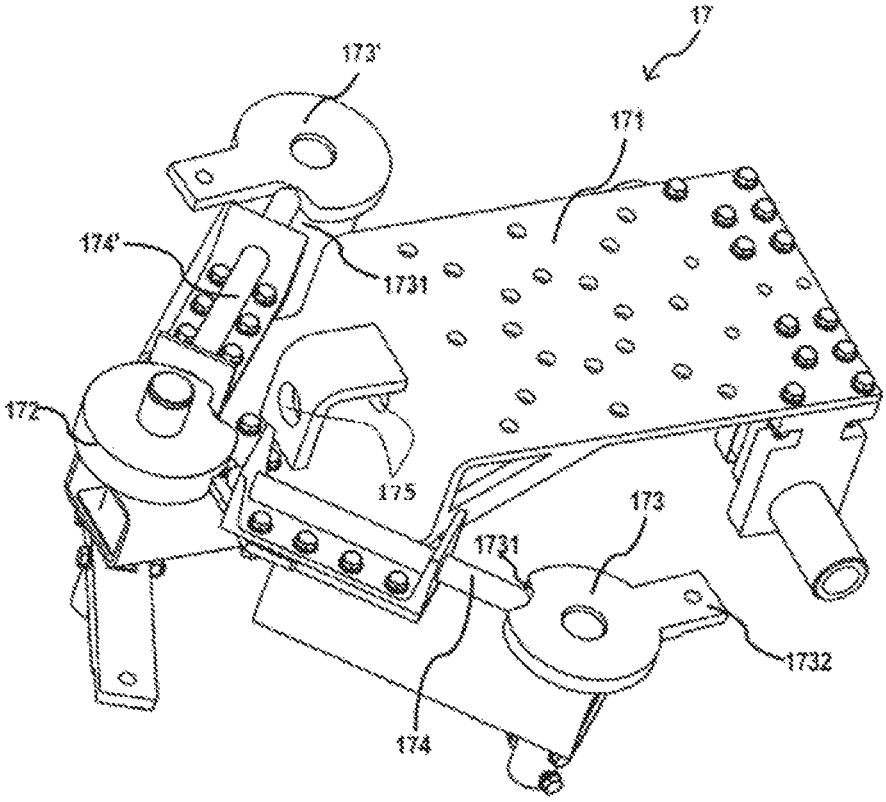
FIG. 2 illustrates the mechanical interlock assembly for a disconnector and an earthing switch mounted in the switch device in FIG. 1.

In order to ensure the above operation relations between the disconnector 11 and the two earthing switches 12 and 13, a mechanical interlock assembly for disconnector and earthing switch 17 is provided in this switch device. With reference to FIG. 2, the mechanical interlock assembly comprises a main interlock disc 172 which is rotatably supported on a switch seat 171 in a horizontal plane. The switch seat 171 is mounted on the first mounting column 14 and is also used to support the movable contact of the first earthing switch 12. The main interlock disc 172 is rotated by a rotating shaft 18 from a transmission box 19 as shown in FIG. 1, and further drives a rotatable insulating member 20 to rotate so as to actuate the movable contact of the disconnector 11 pivoting about the pivot axis by means of a linkage mechanism 21. Thereby, the disconnector 11 can be actuated to be closed or opened.

Figure 3:
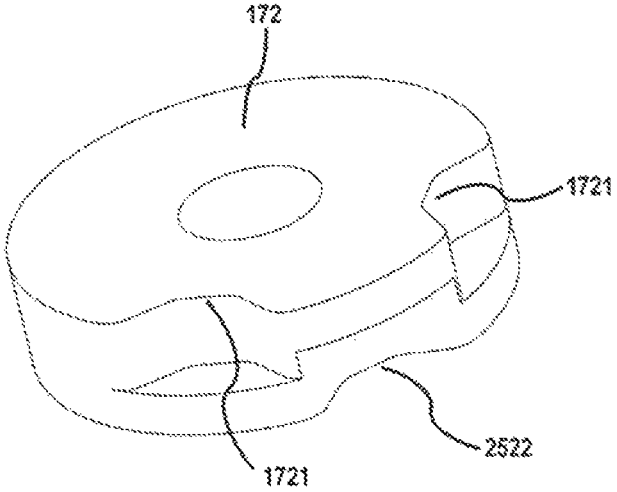
FIG. 3 illustrates a main interlock disc of the mechanical interlock assembly according to an embodiment of the present invention.

With reference to FIGS. 2-3, the mechanical interlock assembly further comprises two earthing switch interlock discs 173 and 173' rotatably supported on the switch seat 171 in a horizontal plane. Each of the two earthing switch interlock discs is rotated by a rotating shaft 18 from a transmission box 19, and further drives an linkage mechanism 22 so as to actuate the respective movable contacts of the first earthing switch 12 and the second earthing switch 13 pivoting about the pivot axes of the earthing switches respectively by means of a linkage mechanism. Thereby, the first earthing switch 12 and the second earthing switch 13 can be actuated to be closed or opened. Each of the earthing switch interlock discs may has an arm 1732 extending from the circumference of the earthing switch interlock discs in the radial direction for connecting the linkage mechanism to actuate the movable contact of the corresponding earthing switch. By the protruded arm 1732, the length between the joint to the linkage mechanism and the pivot axis of the earthing switch interlock disc is elongated. Thus, the linkage mechanism can obtain a large moving stroke to actuate the movable contact of the earthing switch pivoting in a large range of angle.

In an embodiment, the two earthing switch interlock discs 173 and 173' are disposed on two opposite sides of the switch seat 171 to be adapted to the first and second earthing switches supported on the two opposite sides of the switch seat 171, while the main interlock disc 172 is disposed in the middle of the two earthing switch interlock discs 173 and 173'. Thus, the main interlock disc 172 forms an isosceles triangle with the two earthing switch interlock discs 173 and 173'.

The mechanical interlock assembly further comprises two movable interlock pins 174 and 174' disposed between the main interlock disc 172 and each of the first and second earthing switch interlock discs respectively. The interlock pins 174 and 174' are also movably supported on the switch seat 171.

The main interlock disc 172 is provided with two first grooves 1721 disposed along the circumference of the main interlock disc 172 (FIG. 3), and each of the two earthing switch interlock discs is provided with a third groove 1731 (FIG. 2). The length of the interlock pins 174 and 174' is configured such that: when the first groove 1721 on the main interlock disc 172 and the third groove 1731 on each earthing switch interlock disc are aligned with the respective interlock pin between the main interlock disc 172 and the corresponding earthing switch interlock disc, the corresponding interlock pin can be moved into or out of the first groove 1721 on the main interlock disc 172 and the third groove 1731 on the earthing switch interlock disc; and when any of the first groove 1721 on the main interlock disc 172 and the third groove 1731 on the earthing switch interlock disc is not aligned with the interlock pin, the interlock pin would be locked into the groove which is still aligned with the interlock pin and cannot be moved to get out of the groove aligned with the interlock pin, such that the disc with the groove thereof aligned with the interlock pin is prevented from rotating.

The main interlock disc 172 and the earthing switch interlock discs 173 and 173' should be coupled to the respective linkage mechanism for the disconnector 11 and the first and second earthing switches 12 and 13 properly such that when the main interlock disc 172 is rotated to its locked position, the disconnector 11 is actuated to be in its open state, and when the earthing switch interlock discs 173 and 173' are rotated to their locked position, the first and second earthing switches 12 and 13 are actuated to be in their open state.

Figure 4:
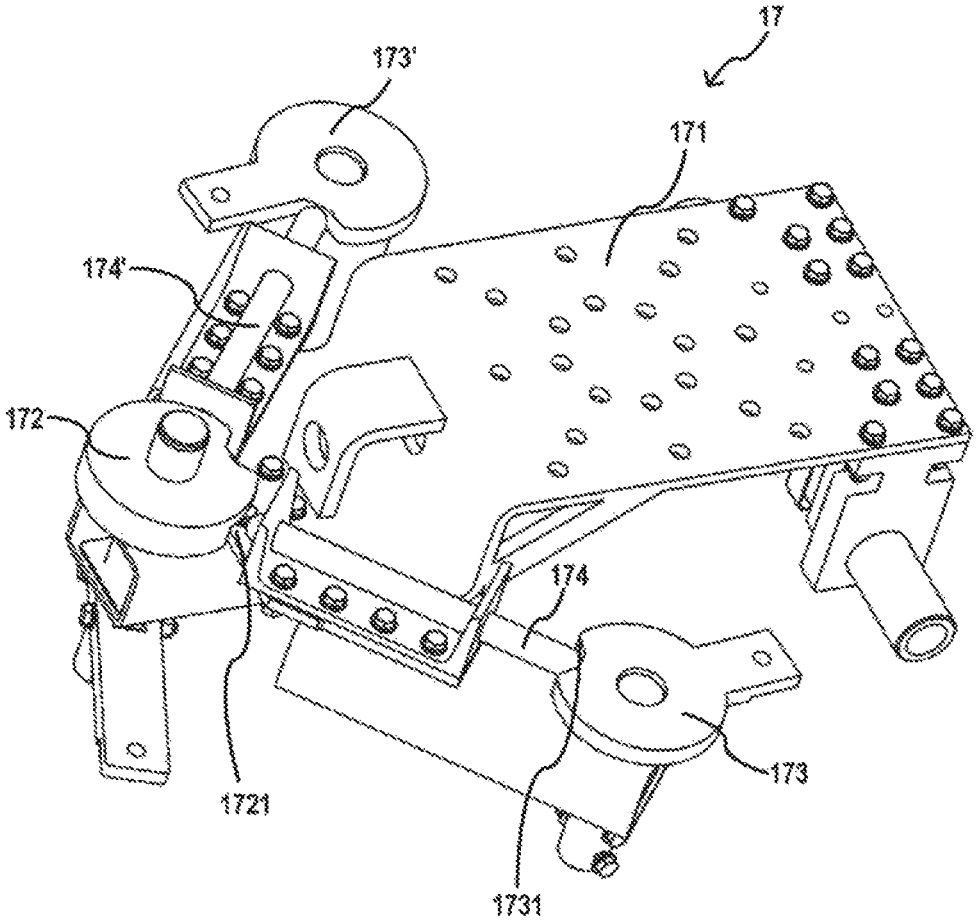
FIG. 4 illustrates the state of the mechanical interlock assembly in FIG. 1 when the disconnector is open and at least one earthing switch is open.
Figure 5:
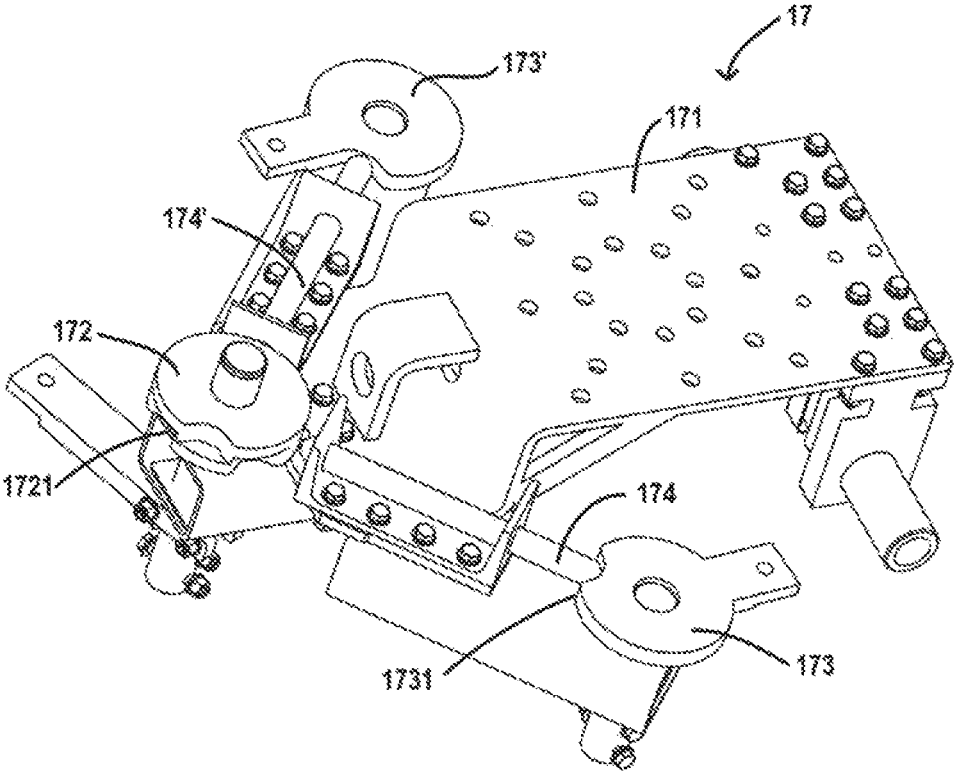
FIG. 5 illustrates the state of the mechanical interlock assembly FIG. 1 when the disconnector is closed and at least one earthing switch is open.
Figure 6:
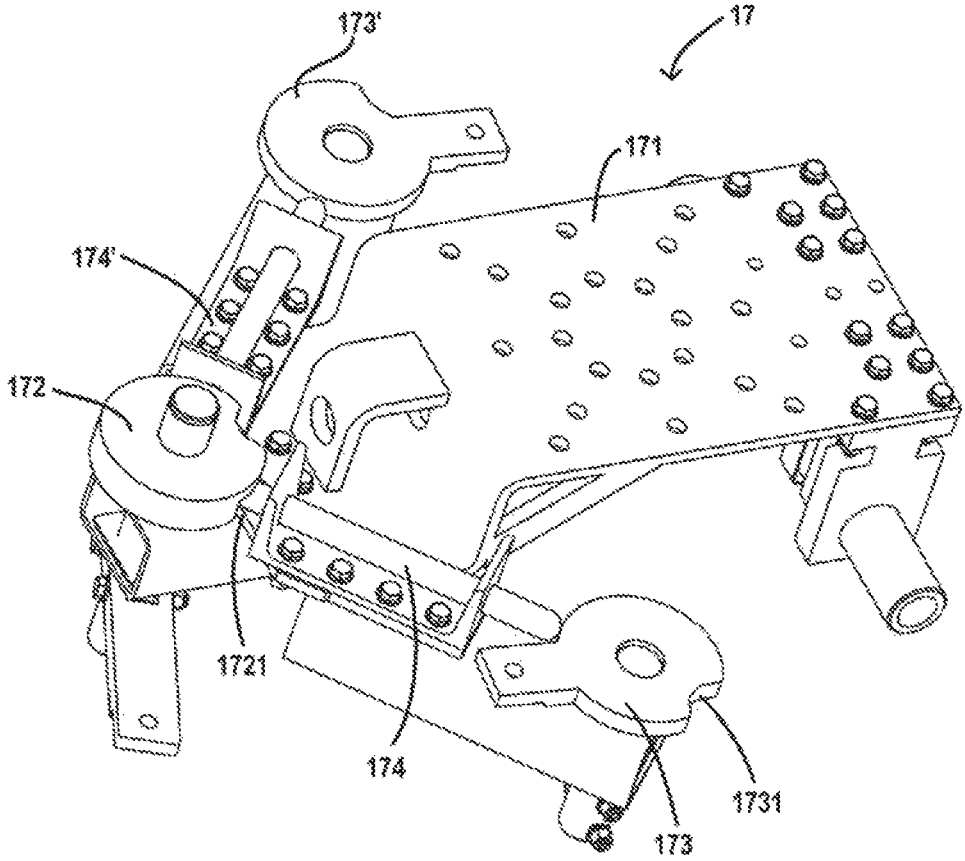
FIG. 6 illustrates the state of the mechanical interlock assembly FIG. 1 when the disconnector is open and at least one earthing switch is closed.

Let's discuss the interlocking process of the mechanical interlock assembly for the disconnector 11 and the first earthing switch 12 with reference to FIGS. 4-6. When the disconnector 11 and the first earthing switch 12 are both in the open state (FIG. 4), the first groove 1721 on the main interlock disc 172 and the third groove 1731 on the earthing switch interlock disc 173 are both aligned with the interlock pin 174, and the distance between the first groove 1721 and the third groove 1731 is larger than the length of the interlock pin 174. Thus, the interlock pin 174 is free to move between the main interlock disc 172 and the earthing switch interlock disc 173. In this case, both the main interlock disc 172 and the earthing switch interlock disc 173 can be rotated to actuate the disconnector 11 and the first earthing switch 12 respectively without being locked by the interlock pin 174.

With reference to FIG. 5, in the case that the first earthing switch 12 is in the open state, the rotating shaft 18 from the transmission box 19 associated with the disconnector 11 can rotate the main interlock disc 172 and in turn actuate the disconnector 11 to the closed state. As a result, the first groove 1721 is rotated away from the position aligning with the interlock pin 174, and the circumference of the main interlock disc 172 contacts and pushes the interlock pin 174 moving into the groove 1731 on the earthing switch interlock disc 173. In this case, the earthing switch interlock disc 172 would be blocked by the interlock pin 174 and cannot be rotated to actuate the first earthing switch 12. In this way, the closing of the first earthing switch 12 is prohibited when then disconnector 11 is closed.

Only when the main interlock disc 172 is rotated back to actuate the disconnector 11 to the open state and the first groove 1721 returns to align with the interlock pin 174 as shown in FIG. 4, there is a room for the interlock pin 174 to be moved out of the third groove 1731 to unlock the first earthing switch 12. In this case, the rotating shaft 18 from the transmission box 19 associated with the first earthing switch 12 can rotate the earthing switch interlock disc 173, such that the earthing switch interlock disc 173 can push the interlock pin 174 moving out of the third groove 1731 and into the first groove 1721 on the main interlock disc 172 (see FIG. 5), and the first earthing switch 12 is actuated to be closed. As a result, the main interlock disc 172 would be blocked by the interlock pin 174 and cannot be rotated to actuate the disconnector 11. In this way, the closing of the disconnector 11 is prohibited when then earthing switch interlock disc 173 is closed.

In order to facilitate the main interlock disc 172 pushing the interlock pins 174 and 174' out of the first groove 1721 and facilitate the earthing switch interlock discs 173 and 173' pushing the interlock pins 174 and 174' out of the third groove 1731, preferably, the interlock pins 174 and 174' are rounded at both ends thereof, for example, to form a half-spherical face or a half-ellipsoid, so as to prevent the end of the interlock pins 174 and 174' from being jammed by the first groove 1721 or the third groove 1731 when the corresponding main interlock disc or earthing switch interlock disc rotates. However, the cross section of the interlock pins 174 and 174' may be in any suitable shape, such as in circular shape or in squared shape.

Normally, the requirement for the operation of the second earthing switch 13 is the same as the first earthing switch 12. Therefore, the locking and unlocking operations for the second earthing switch 13 in FIGS. 4-6 are synchronous with the first earthing switch 12, and the detailed discussion for this is omitted.

Although in the above embodiments, the interlock assembly is illustrated with two earthing switches 12 and 13, it is appreciated that the interlock assembly can also be used to realize the interlock between a disconnector 11 and only one earthing switch. In this case, the inactive earthing switch disc is not connected to an earthing switch or a rotation shaft, or the inactive earthing switch disc and inactive interlock pin can even be omitted.

Figure 7:
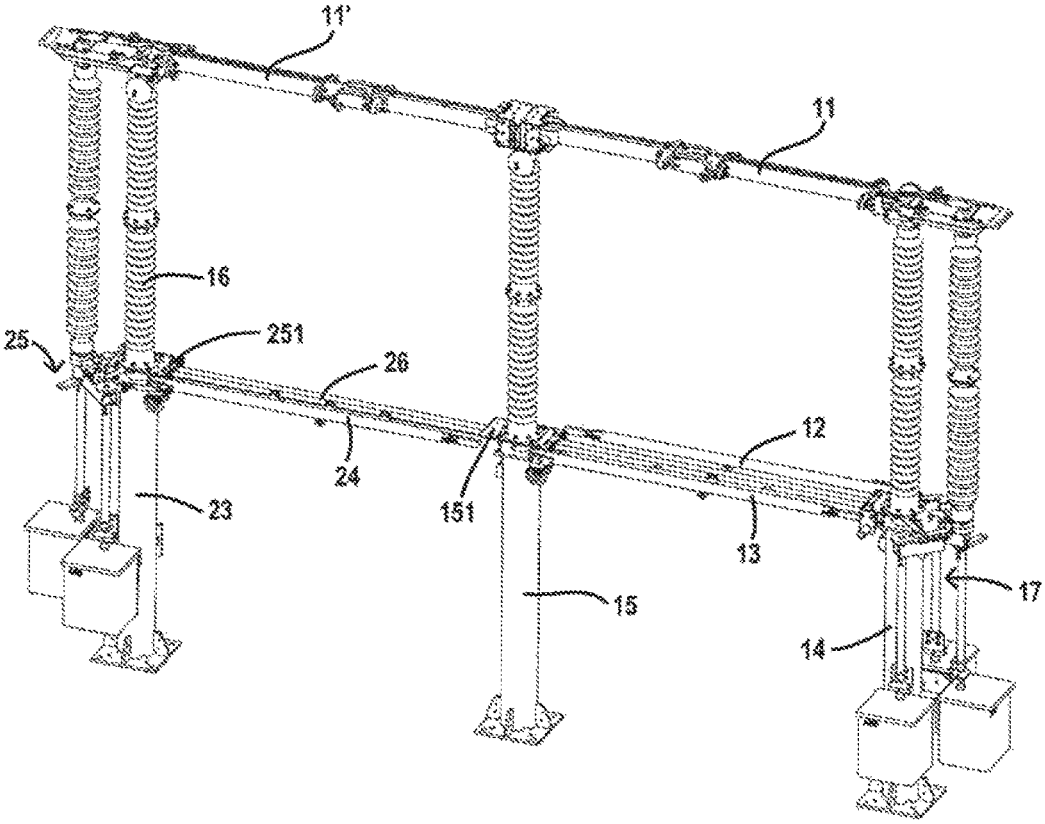
FIG. 7 illustrates another switch device, comprising a mechanical interlock assembly for a disconnector and an earthing switch according to an embodiment of the present invention.

FIG. 7 illustrates another switch device. This switch device comprises two disconnectors 11 and 11' respectively electrically connected in two power lines which are connected in parallel. This is a common arrangement for facilitating opening one power line for maintenance while keeping the other power line closed. The structure of the first disconnector 11 is the same as the disconnector 11 in FIG. 1, and is also supported between the first mounting column 14 and the second mounting column 15, and may also have two associated earthing switches 12 and 13 and the interlock assembly 17 for interlocking the first disconnector 11 and the two earthing switches 12 and 13.

A second disconnector 11' is supported between a third mounting column 23 and the second mounting column 15. The movable contact of the second disconnector 11' is supported on the third mounting column 23 via an insulating member 16, and the stationary contact of the second disconnector 11' is also mounted on the second mounting column 15 and is electrically connected to the stationary contact of the first disconnector 11. A third earthing switch 24 is electrically connected between the movable contact side of the second disconnector 11' and the ground. In this arrangement, the second earthing switch 13 is electrically connected between the common stationary contact side of the first and second disconnectors and the ground, and servers as a common earthing switch for both of the first and second disconnectors. The actuating mechanisms for the second disconnector 11' and the third earthing switch 24 are the same as the first disconnector 11 and the first and second earthing switches respectively.

For this arrangement, the interlock between the first disconnector 11 and the first and second earthing switches 12 and 13 is also required and is realized by the interlock assembly 17 as illustrated with reference to FIGS. 1-6. Furthermore, the interlock between the second disconnector 11' and the third and second earthing switches 24 and 13 is also required, so as to ensure both of the third and second earthing switches are in an open state when the second disconnector 11' is closed, and the second disconnector 11' is in an open state when any of the third and second earthing switches is in closed.

Figure 8:
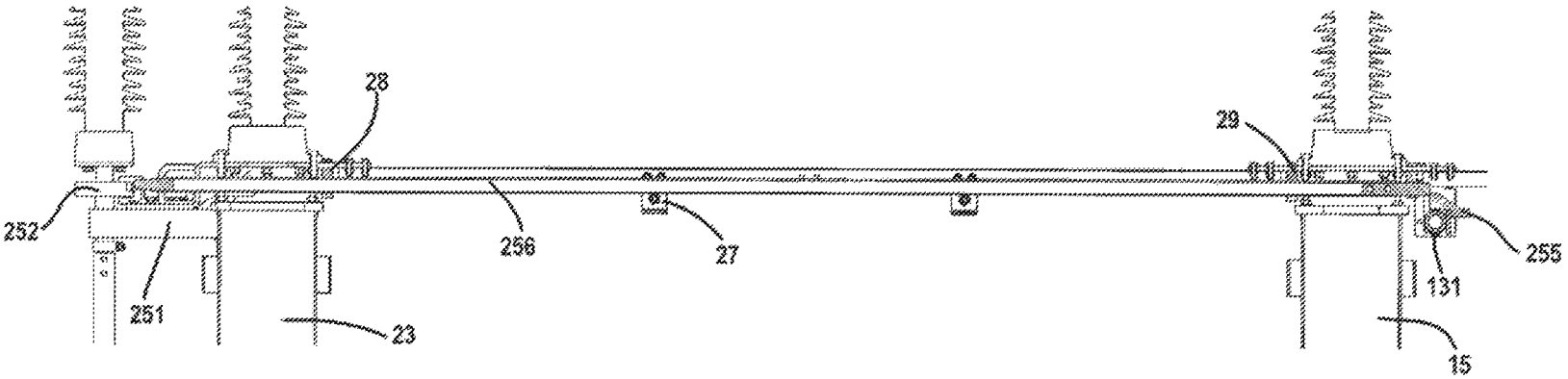
FIG. 8 illustrates the mechanical interlock assembly for a disconnector and an earthing switch mounted in the switch device in FIG. 7 in a section view.
Figure 9:
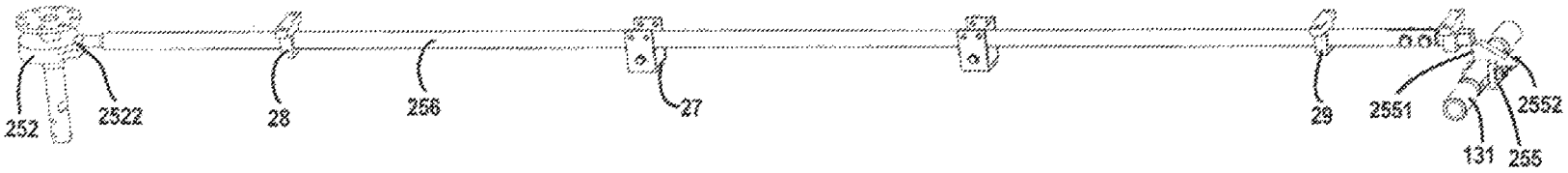
FIG. 9 illustrates the mechanical interlock assembly for a disconnector and an earthing switch mounted in the switch device in FIG. 7 in a perspective view.

In order to interlock the second disconnector 11' and the third and second earthing switches 24 and 13, a second interlock assembly 25 is provided with reference to FIGS. 8-9, this second interlock assembly 25 also comprises a main interlock disc 252 rotatably supported on a switch seat 251 in a horizontal plane. The switch seat 251 is configured to pivotably support the third earthing switch 24. The main interlock disc 252 is also rotated by a rotating shaft from a transmission box to actuate the movable contact of the second disconnector. The main interlock disc 252 comprises a second groove 2522 on the circumference thereof. The second interlock assembly 25 further comprises an interlock plate 255 which is fixed to a pivot pin 131 of the movable contact of the second earthing switch 13 by, for example, a U-shaped screw, such that the interlock plate 255 can be rotated along with the pivot of the movable contact of the second earthing switch 13.

Since the movable contact of the second earthing switch 13 is pivotable in a vertical plane perpendicular to the ground, the interlock plate 255 is also pivotable in the vertical plane which is also perpendicular to the horizontal rotating plane of the main interlock disc 252. The rotating track of the interlock plate 255 is indicated by dotted line in FIG. 13. The interlock plate 255 comprises a first engaging surface 2551 and a second engaging surface 2552 (see FIG. 13) generally perpendicular to each other. The first engaging surface 2551 and the second engaging surface 2552 are configured such that: the distance between the rotating axis of the main interlock disc 252 and the first engaging surface 2551 when the first engaging surface 2551 is rotated to right face the main interlock disc 252 is greater than the distance between the rotating axis of the main interlock disc 252 and the second engaging surface 2552 when the second engaging surface 2552 is rotated to right face the main interlock disc 252. It is noted that the positions of the first engaging surface 251 and the second engaging surface 2552 in which the first engaging surface 2551 and the second engaging surface 2552 right face the main interlock disc 252 as mentioned above are intended to describe such a position that the first or second engaging surface is in a vertical position perpendicular to the ground and also faces the main interlock disc 252.

Figure 10:
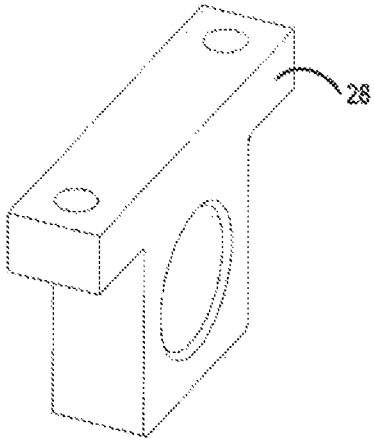
FIG. 10 illustrates a guiding member in the mechanical interlock assembly of FIG. 8.
Figure 11:
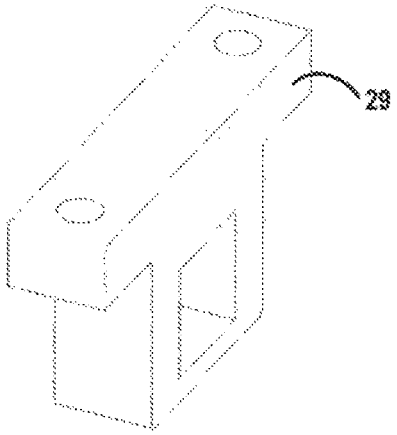
FIG. 11 illustrates another guiding member in the mechanical interlock assembly of FIG. 8.
Figure 12:
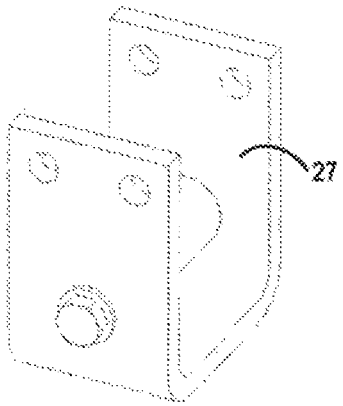
FIG. 12 illustrates a supporting member in the mechanical interlock assembly of FIG. 8.

The second interlock assembly 25 further comprises an interlock rod 256 movably supported between the main interlock disc 252 and the interlock plate 255. The interlock rod 256 is supported by the switch seat 251 and may also be supported by other supporting members 27 mounted on a beam 26 between the second mounting column 15 and the third mounting column 23. The supporting members 27 can be rollers 27 (FIG. 12) to reduce the friction to the interlock rod 256 when the interlock rod 256 is moving. The interlock rod 256 is substantially parallel to the beam 26 and can be hided under the beam 26. The interlock rod 256 can also be guided with guiding members 28 and 29 (FIGS. 10-11) which are mounted on the switch seat 251 and another switch seat 151 on the second mounting column 15. By the supporting of the several supporting members and guiding members along the longitudinal direction of the interlock rod 256, the interlock rod 256 can be provided with a large length between the switch seat 251 and the another switch seat 151 without a significant bending.

The function of the interlock rod 256 is similar to the interlock pin 174. The length of the interlock rod 256 is configured such that: when the second groove 2522 on the main interlock disc 251 is aligned with the interlock rod 256 and the first engaging surface 252 on the interlock plate 255 right faces the main interlock disc 252, the interlock rod 256 can be moved into or out of the second groove 2522, and can be moved to be engaged or disengaged with the first engaging surface 2551; and when the second groove 2522 is not aligned with the interlock rod 256 or the second engaging surface 2552 right faces the main interlock disc 252, the interlock rod 256 would be locked between the main interlock disc 252 and the interlock plate 255 and cannot be moved, such that the main interlock disc 252 or the interlock plate 255 is prevented from rotating.

The main interlock disc 252 and the interlock plate 255 should be properly coupled to the linkage mechanism for the second disconnector 11' and the pivot pin 131 of second earthing switches 13 respectively such that when the main interlock disc 252 is rotated to its locked position, the second disconnector 11' is actuated to be right in its open state, and when the second engaging surface 2552 of the interlock plate 255 is rotated to its locked position, the second earthing switch 13 is right in its open state.

Figure 13:
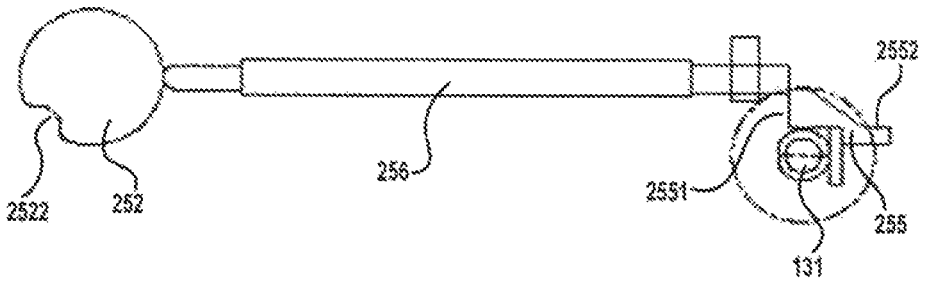
FIG. 13 schematically illustrates the state of the mechanical interlock assembly in FIG. 7 when the disconnector is closed and the earthing switch is open.

Let's discuss the interlocking process of the second mechanical interlock assembly for the second disconnector 11' and the second earthing switch 13 with reference to FIGS. 13-16. It is noted that in FIGS. 13-16, the main interlock disc 252 is shown in a top view for better showing the position of the second groove 2522, while the other parts are shown in a front view. When the second disconnector 11' is in the closed state (FIG. 13), the second groove 2522 on the main interlock disc 252 is not aligned with the interlock rod 256, and the circumference of the main interlock disc 252 pushes the interlock rod 256 to engage with the first engaging surface 2551 of the interlock plate 255. In this position the movable contact of the second earthing switch 13 is in an open state as shown in FIG. 7. If the movable contact of the second earthing switch 13 is intended to be actuated to a closed state, the movable contact and the corresponding pivot pin 131 would have to be rotated in the counter-clockwise direction as shown in FIG. 13. However, because the interlock rod 256 is pushed by the main interlock disc 252 against the first engaging surface 2551, the counter-clockwise rotation of the interlock plate 255 and the associated pivot pin 131 and the movable contact of the second earthing switch 13 is stopped. As a result, the second earthing switch 13 is locked in the open state when the second disconnector 11' is in the closed state.

Figure 14:
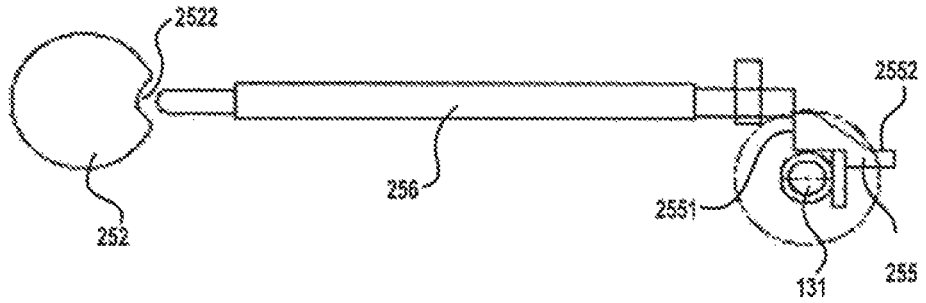
FIG. 14 schematically illustrates the state of the mechanical interlock assembly in FIG. 7 when the disconnector is open and the earthing switch is open.
Figure 15:
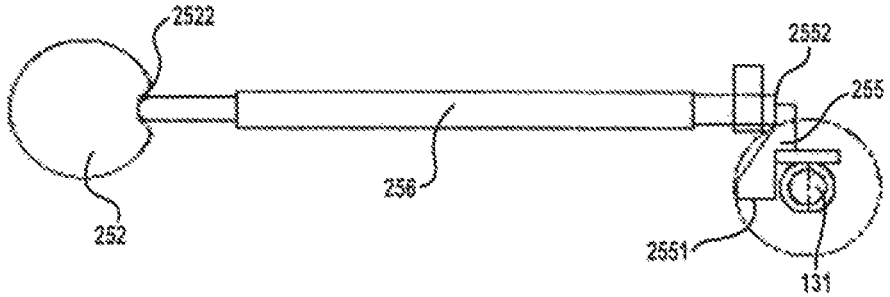
FIG. 15 schematically illustrates the state of the mechanical interlock assembly in FIG. 7 when the disconnector is open and the earthing switch is closed.

With reference to FIGS. 14-15, if the main interlock disc 252 is rotated to actuate the movable contact of the second disconnector 11' to the open state, the main interlock disc 252 would be rotated such that the second groove 2522 is aligned with the interlock rod 256. In this case, the movable contact of the second earthing switch 13 can be actuated to the closed state, with the pivot pin 131 and the interlock plate 255 being rotate din the counter-clockwise direction to push the interlock rod 256 into the second groove 2522 until the second engaging surface 2552 of the interlock plate 255 is rotated to the vertical position. Since the second engaging surface 2552 of the interlock plate 255 locks the interlock rod 256 in the second groove 2522, the main interlock disc 252 cannot be rotated to actuate the movable contact of the second disconnector 11' to the closed state when the second earthing switch 13 is in the closed state.

Figure 16:
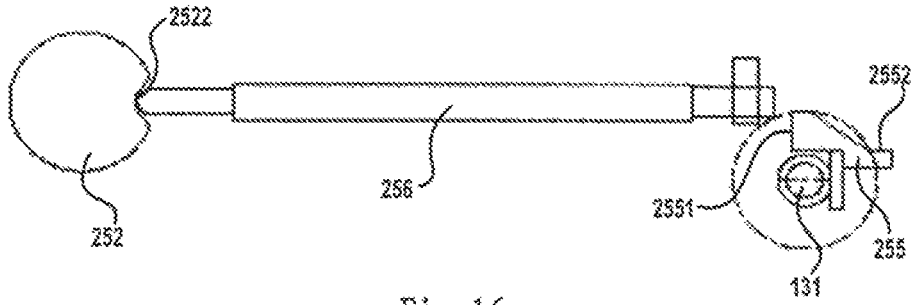
FIG. 16 schematically illustrates the state of the mechanical interlock assembly in FIG. 7 when the disconnector is open and the earthing switch is open.

With reference to FIG. 16, if the second earthing switch 13 is actuated to the open state, the interlock plate 255 and the pivot pin 131 would be rotated in the clockwise direction along with the movable contact of the second earthing switch 13. The second engaging surface 2552 is thus rotated away form the interlock rod 256 and the first engaging surface 2551 is rotated to the vertical position and there is a room between the interlock rod 256 and the second engaging surface 2551. In this case, the main interlock disc 252 can be rotated to push the interlock rod 256 out of the second groove 2522 and further engaged with the first engaging surface 2552. As a result, the movable contact of the second disconnector 11' is actuated by the main interlock disc 252 to the closed state, and the state of the interlock assembly returns to the state as shown in FIG. 13, wherein the counter-clockwise rotation of the interlock plate 255 and the associated pivot pin 131 and the movable contact of the second earthing switch 13 is stopped. Therefore, the second earthing witch 13 is locked in the open state again.

In order to facilitating the main interlock disc 252 pushing the interlock rod 256 out of the second groove 2522, preferably, the interlock rod 256 is also rounded (for example to form a half-spherical face or a half-ellipsoid) at one end which is intended to be engaged with the second groove 2552 when the main interlock disc 252 rotates.

For the other end of the interlock rod 256 which is intended to be engaged with the interlock plate 255, it is preferably a planar end face or an end face with other kinds of shaped fitting the first engaging surface 2551 and the second engaging surface 2552, so as to increase the area of the end face to ensure a reliable engagement between the end of the interlock rod 256 and the first and second engaging surfaces of the interlock plate 255. Preferably, most portions of the interlock rod 256 has a circular cross-section, and only a section of square rod is fixed to the end of the interlock rod 256 which is intended to be engaged with the interlock plate 255. In this case, the guiding member 26 (FIG. 10) on the switch eat 251 has a round hole to be coupled with the rounded end of the interlock rod 256, and the guiding member 29 (FIG. 11) on another switch seat 151 has a square hole to be coupled with the square end of the interlock rod 256. The guiding members 28 and 29 further limit the shaking and bending of the interlock rod 256 when it is moved in the longitudinal direction, so as to increase the reliability of the operation for the interlock assembly. However, it is appreciated that the interlock rod 256 may be substantially a rod with a cross-section shaped in a square or any other shape, and only one end of the rod which is intended to be engaged with the second groove 2522 is rounded.

The second interlock assembly 25 may further comprises the similar structures as in the interlock assembly 17 to realize the interlock between the second disconnector 11' and the third earthing switch 24. Specifically, the second interlock assembly 25 may further comprise an earthing switch interlock disc and an interlock pin as described with reference to FIGS. 1-6. This earthing switch interlock disc is connected to a rotating shaft from a transmission box for actuating the third earthing switch.

The main interlock disc 252 may also be used to cooperate with the interlock pin to realize the interlock between the second disconnector 11' and the third earthing switch 24. To this end, both the first groove 1721 and the second groove 2522 may be provided on one main interlock disc 252. In order to facilitate the main interlock disc 252 engaging with both the interlock rod 256 and the interlock pin, the second groove 2522 is dislocated with the first groove 1721 axially and circumferentially, as shown in FIG. 3. In another words, the second groove 2522 and the first groove 1721 are located in different levels, and spaced away in the circumferential direction. In this way, when the main interlock disc 252 rotates, the interlock rod 256 and the interlock pin can be respectively engaged or disengaged with the second groove 2522 and the first groove 1721 synchronously, without being interfered by each other. As such, the second earthing switch 13 and the third earthing switch 24 can be locked in the open state synchronously when the second disconnector 11' is closed.

Although the second interlock assembly 25 is illustrated in a switch device with two disconnectors in parallel, it is appreciated that it can also be used in other switch devices which also need the interlock between a disconnector and an associated earthing switch. This is particular advantageous for the arrangement in which the associated earthing switch is away from the disconnector since the long interlock rod 256 can realize the interlock between two switches distal form each other.

Preferably, with the exception of the interlock rod 256 and the interlock plate 255, the second interlock assembly 25 may be formed as a universal structure similar to the first interlock assembly 17, such that the resultant interlock assembly may be universal to any embodiment as described in this invention. In this case, the switch seat may has the same structure as shown in FIG. 2, with a main interlock disc 172, two earthing switch interlock discs 172 and 173' and two interlock pins 174 and 174' supported on the switch seat. For the universal structure, the main interlock disc 172 has two first grooves 1721 and one second groove 2522 as shown in FIG. 3. The second groove 2522 is on the different level from the two first grooves 1721, and is in the middle of the two first grooves 1721 in the circumferential direction. The switch seat 171 for the universal structure also has supporting holes 175 to allow the interlock rod 256 passing through to be engaged with the main interlock disc 172.

If this universal structure is used in the embodiments regarding FIGS. 1-6, the second groove 2522 on the main interlock disc 172 is idle, and no interlock rod 256 passes through the supporting holes 175, and if this universal structure is used in the embodiments regarding FIGS. 7-16, one of the two first grooves 1721 may be idle, and an interlock rod 256 passes through the supporting holes 174 to be coupled with the main interlock disc 172.

Since most of the parts for the first interlock assembly 17 and the second interlock assembly 25 form a universal structure, it is convenient to assemble the specific interlock assembly for different arrangements comprising a disconnector and an earthing switch with the universal structure and a few additional parts. This reduces the total number of the parts of the interlock mechanism for different arrangement, simplifies the construction of the interlock mechanism, and increases the flexibility of the interlock mechanism.

It is appreciated that some of the earthing switches in all the embodiments may not be needed, depending on the different demand for the arrangement of the disconnector. In this case, the interlock assembly does not need to be modified significantly, and the only thing needed to be done is to detach the redundant earthing switch from the corresponding interlock disc or interlock plate, while the interlock function for other earthing switches is still active.

For all the embodiments of the present invention as described, the interlock assembly is provided on the location of the switch seat, which does not need complicated and expensive parts to be coupled with the transmission shafts, and fully uses the space of the switch seat and thus saves the total space for the arrangement. Furthermore, since some parts, for example, the main interlock disc and the earthing interlock disc, are existing parts for actuating the disconnector and the earthing switch, the reuse of these parts for interlock function further saves the total number of the parts for the arrangement, which further reduces the cost for the interlock assembly. In addition, since the structure of the interlock assembly is simple, the installation and maintenance for the assembly is easy, and the reliability for interlock is further improved.

The descriptions of the various embodiments of the present invention has been presented for purposes of illustration, but are not intended to be exhaustive or limited to the embodiments disclosed. Many modifications and variations will be apparent to those of ordinary skill in the art without departing form the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

By studying the drawings, the disclosure of the embodiments of the present disclosure, and the mounted Claims, those skilled in the art may understand and implement other modifications of the disclosed embodiments during the implementation of the present disclosure. In the claims, "comprising" does not exclude other elements or steps, and "a" or "one" does not exclude the plural concept. The simple fact of illustrating specific elements in the dependent claims, which are mutually different from each other, does not indicate that the combination of these elements cannot be used advantageously. The labels in drawings of the claims should not be interpreted as limiting the scopes thereof.

Though the present disclosure has been described with reference to the currently considered embodiments, it should be appreciated that the present disclosure is not limited the disclosed embodiments. On the contrary, the present disclosure is intended to cover various modifications and equivalent arrangements falling within in the spirit and scope of the appended claims. The scope of the appended claims is accorded with broadest explanations and covers all such modifications and equivalent structures and functions.

What is claimed is:

1. A mechanical interlock assembly for a disconnector and an earthing switch, comprising:

a main interlock disc configured to actuate a movable contact of a disconnector, at least one earthing switch interlock disc configured to actuate a respective movable contact of at least one earthing switch respectively;

wherein the main interlock disc is provided with at least one first groove, and each of the at least one earthing switch interlock discs are provided with a third groove, and between the main interlock disc and each of the at least one earthing switch interlock discs are provided with a movable interlock pin respectively;

wherein the at least one first groove is aligned with the respective interlock pin when the movable contact of the disconnector is in an open position, such that each of the earthing switch interlock discs are rotatable to push the respective interlock pin to engage with the at least one first groove respectively to stop the main interlock disc from rotating so as to lock the movable contact of the disconnector in the open position while the movable contact of the at least one earthing switch is moved to a closed position; and the third groove on each of the at least one earthing switch interlock discs are aligned with the respective interlock pin when the movable contact of each of the earthing switches are in an open position, such that the main interlock disc is rotatable to push the respective interlock pin to engage with the third groove on each of the at least one earthing switch interlock discs respectively to stop each of the at least one earthing switch interlock discs from rotating so as to lock the movable contact of each earthing switch in the open position while the movable contact of the disconnector is moved to a closed position.

2. The mechanical interlock assembly according to claim 1, wherein the main interlock disc, the at least one earthing switch interlock disc and the respective interlock pin are supported by a switch seat, and said switch seat is configured to pivotably support the movable contact of the at least one earthing switch.

3. The mechanical interlock assembly according to claim 2, wherein the mechanical interlock assembly comprises two earthing switch interlock discs disposed on two opposite sides of the switch seat respectively, and the main interlock disc is disposed on one end of the switch seat between the opposite two sides, and two first grooves are provided on the main interlock disc along a circumferential direction of the main interlock disc.

4. The mechanical interlock assembly according to claim 2, wherein each of the at least one earthing switch interlock discs comprises an arm extending from a circumference of the earthing switch interlock discs in a radial direction for connecting a linkage mechanism to actuate the movable contact of the corresponding earthing switch.

5. The mechanical interlock assembly according to claim 2, wherein the main interlock disc further comprises a second groove on a circumference of the main interlock disc which can be used to be engaged with an interlock rod to interlock the disconnector connected to the main interlock disc and an additional earthing switch.

6. The mechanical interlock assembly according to claim 5, wherein the second groove is dislocated with the at least one first groove axially and circumferentially.

7. The mechanical interlock assembly according to claim 1, wherein each of the at least one earthing switch interlock discs comprises an arm extending from a circumference of the earthing switch interlock discs in a radial direction for connecting a linkage mechanism to actuate the movable contact of the corresponding earthing switch.

8. The mechanical interlock assembly according to claim 1, wherein the main interlock disc further comprises a second groove on a circumference of the main interlock disc which can be used to be engaged with an interlock rod to interlock the disconnector connected to the main interlock disc and an additional earthing switch.

9. The mechanical interlock assembly according to claim 8, wherein the second groove is dislocated with the at least one first groove axially and circumferentially.

10. A switch device, comprising a disconnector, at least one earthing switch and a mechanical interlock assembly for a disconnector and an earthing switch according to claim 1, wherein the at least one earthing switch is connected with the disconnector on the movable contact side and/or a stationary contact side of the disconnector.

11. A mechanical interlock assembly for a disconnector and an earthing switch, comprising:

a main interlock disc having a second groove on a circumference of the main interlock disc, configured to actuate a movable contact of a disconnector;

an interlock plate, which is fixed to a pivot pin of a movable contact of an earthing switch; and an interlock rod movably supported between the main interlock disc and the interlock plate;

wherein the second groove is aligned with the interlock rod when the movable contact of the disconnector is in an open position, such that the interlock plate is rotatable in a first direction along with the movable contact of the earthing switch to push the interlock rod to engage with the second groove to stop the main interlock disc from rotating so as to lock the movable contact of the disconnector in the open position while the movable contact of the earthing switch is rotated to a closed position; and the main interlock disc is rotatable when the movable contact of the earthing switch is in an open position, to push the interlock rod to move towards the interlock plate to stop the interlock plate from rotating in the first direction so as to lock the movable contact of the earthing switch in the open position while the movable contact of the disconnector is actuated to a closed position.

12. The mechanical interlock assembly according to claim 11, wherein the interlock plate comprises a first engaging surface and a second engaging surface, wherein the first engaging surface and the second engaging surface are configured such that: the distance between a rotating axis of the main interlock disc and the first engaging surface when the first engaging surface is rotated to right face the main interlock disc, is greater than the distance between the rotating axis of the main interlock disc and the second engaging surface when the second engaging surface is rotated to right face the main interlock disc.

13. The mechanical interlock assembly according to claim 12, wherein one end of the interlock rod engaging with the second groove is rounded, and another end of the interlock rod engaging with the interlock plate is planar.

14. The mechanical interlock assembly according to claim 11, wherein one end of the interlock rod engaging with the second groove is rounded, and another end of the interlock rod engaging with the interlock plate is planar.

15. The mechanical interlock assembly according to claim 11, wherein the interlock rod is supported by at least one roller, and is guided by at least one guiding member.

16. The mechanical interlock assembly according to claim 11, wherein the rotatable main interlock disc is supported on a switch seat, and said switch seat is configured to pivotably support a movable contact of at least one additional earthing switch.

17. The mechanical interlock assembly according to claim 11, which further comprises at least one earthing switch interlock disc configured to actuate a movable contact of at least one additional earthing switch respectively; and wherein the main interlock disc is further provided with at least one first groove, and each of the at least one earthing switch interlock discs are provided with a third groove, and between the main interlock disc and each earthing switch interlock disc is provided with a movable interlock pin respectively for engaging with the first groove or the third groove, so as to interlock the disconnector and the at least one additional earthing switch.

18. A switch device, comprising a first disconnector having a first movable contact, a second disconnector having a second movable contact, at least one earthing switch and a mechanical interlock assembly for a disconnector and an earthing switch according to claim 11, wherein one of the at least one earthing switch is connected to a common stationary contact side of the first and second disconnectors, and the interlock plate of the mechanical interlock assembly is fixed to the pivot pin of the movable contact of the earthing switch connected to the common stationary contact side; and the main interlock disc of the mechanical interlock assembly is configured to actuate the second movable contact of the second disconnector, such that the mechanical interlock assembly is configured to interlock the second movable contact of the second disconnector and the earthing switch connected to the common stationary contact side.

* * * * *